United States Patent [19]

Donnelly

[11] 4,083,191

[45] Apr. 11, 1978

[54] PIER FOR FOUNDATION LEVELING

[76] Inventor: Emmett F. Donnelly, 3507 Mayhew Dr., Dallas, Tex. 75228

[21] Appl. No.: 759,772

[22] Filed: Jan. 14, 1977

[51] Int. Cl.[2] ..... E02D 35/00

[52] U.S. Cl. ..... 61/51; 248/354 S; 254/133 A

[58] Field of Search ..... 61/91, 51, 52; 248/354 S, 357; 254/98, 133 A

[56] References Cited

U.S. PATENT DOCUMENTS

| | | | |
|---|---|---|---|
| 1,061,658 | 5/1913 | Bradshaw | 254/133 A |
| 2,979,304 | 4/1961 | Teel | 248/354 S |
| 3,398,933 | 8/1968 | Haroldson | 254/98 |
| 3,850,397 | 11/1974 | Kutchai | 248/354 S |

FOREIGN PATENT DOCUMENTS

| | | | |
|---|---|---|---|
| 760,646 | 11/1956 | United Kingdom | 61/91 |

*Primary Examiner*—Paul R. Gilliam
*Assistant Examiner*—David H. Corbin
*Attorney, Agent, or Firm*—Richards, Harris & Medlock

[57] ABSTRACT

A pier for foundation leveling includes first and second end plates. The first end plate has apertures formed therethrough and pipe sections extending from the apertures toward the second end plate. The second end plate has a plurality of pipe sections each aligned with one of the pipe sections of the first end plate. A plurality of bolts are secured to the first end plate and extend through the apertures and pipe sections thereof into the pipe sections of the second end plate. A plurality of nuts are threadedly engaged with the bolts and function to position the second end plate with respect to the first end plate.

4 Claims, 2 Drawing Figures

PIER FOR FOUNDATION LEVELING

BACKGROUND AND SUMMARY OF THE INVENTION

This invention relates to foundation leveling piers, and more particularly to a pier which is permanently installed to maintain the foundation of a building in a level condition.

In many areas of the country, houses and similar buildings are constructed either on a concrete slab or by means of the pier and beam construction method. In either event, damage to the structure is sometimes encountered, such as cracks in brick walls, separation of the wall from windows, doors, etc. It is then necessary to level the foundation of the structure in order to close the cracks or separations.

At the present time, the leveling procedure involves the use of a jack to raise the appropriate portion of the foundation and thereby close the crack or separation. A concrete pier is then formed beneath the foundation to retain the foundation and the walls supported thereby in their leveled condition. In some instances a wooden beam or a length of pipe is used to support the structure while the concrete hardens, thereby permitting removal of the jack much sooner than would otherwise be possible. It will be appreciated that this procedure does not permit readjustment of the leveling operation should it become necessary.

The present invention relates to a foundation leveling pier which overcomes the foregoing and other difficulties long since associated with the prior art. In accordance with the invention, a pier comprises opposed end plates each having aligned pipe sections extending therefrom. A plurality of bolts are secured to one of the end plates and extend through the pipe sections thereof into the pipe sections of the other end plate. A plurality of nuts are threadedly received on the bolts and are positioned between the pipe sections of the two end plates. The nuts are utilized to position the end plates with respect to each other.

In the practice of the invention, a reinforced concrete pad is formed at an appropriate location under a beam comprising part of a foundation to be leveled. The foundation is then raised by means of a jack, after which the pier of the present invention is positioned between the concrete pad and the beam. The pier is then adjusted to maintain the foundation in the leveled condition. If subsequent readjustment of the leveling operation is necessary, the jack is again used to maintain such readjustment, after which the pier is utilized to maintain the foundation in the readjusted condition.

DESCRIPTION OF THE DRAWINGS

A more complete understanding of the invention may be had by reference to the following Detailed Description when taken in conjunction with the accompanying Drawings, wherein.

DETAILED DESCRIPTION

Figure 1:
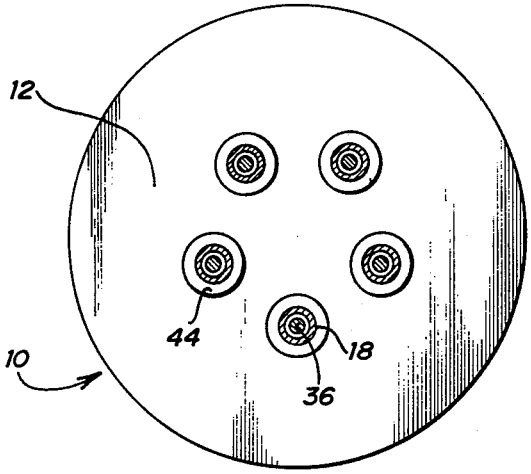
FIG. 1 is a top view of a foundation leveling pier incorporating the invention.
Figure 2:
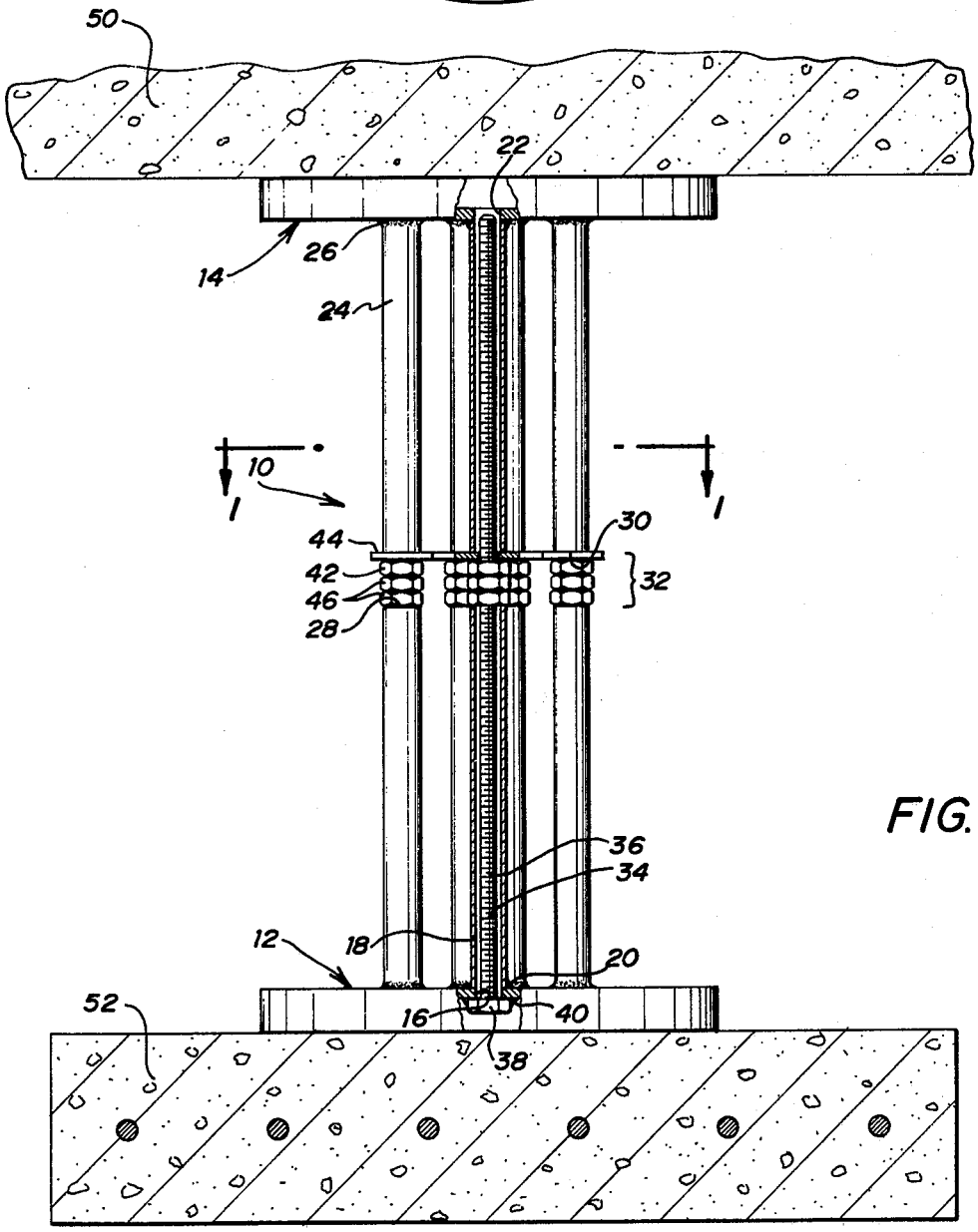
FIG. 2 is a side view of the pier showing the use thereof, wherein certain parts have been broken away more clearly to illustrate certain features of the invention.

Referring now to the Drawings, and particularly to FIG. 2 thereof, there is shown a pier for foundation leveling 10 incorporating the invention. The pier 10 includes a first end plate 12 and a second end plate 14. Although the pier 10 is illustrated in FIG. 2 with the first end plate 12 positioned downwardly and the second end plate 14 positioned upwardly, the pier 10 will operate with equal facility with the end plates 12 and 14 oriented oppositely.

The end plate 12 has a plurality of apertures 16 formed therein. In certain applications of the invention the apertures 16 are located relatively centrally, as shown in FIG. 2. In other applications of the invention the apertures 16 are located more closely adjacent to the periphery of the plate 12. The positioning of the apertures 16 is not critical to the practice of the invention, and is preferably determined in accordance with the requirements of a particular application of the invention.

The first end plate 12 has a plurality of pipe sections 18 secured thereto. Each of the pipe sections 18 is aligned with one of the apertures 16. As is best shown at 20, the pipe sections 18 are preferably secured to the end plate 12 by welding. The inside diameter of the pipe sections 18 is equal to or greater than the diameter of the apertures 16 formed in the plate 12.

The second end plate 14 has a plurality of apertures 22 formed therein. The apertures 22 are equal in number to and are aligned with the apertures 16 formed in the first end plate 12. The second end plate 14 has a plurality of pipe sections 24 secured thereto. As is best shown at 26, the pipe sections 24 are secured to the second end plate 14 by welding.

The pipe sections 24 of the second end plate 14 are aligned with the pipe sections 18 of the first end plate 12. The inside diameter of the pipe sections 24 is preferably identical to the inside diameter of the pipe sections 18. The pipe sections 18 extend to end surfaces 28, and the pipe sections 24 extend to end surfaces 30. The end surfaces 28 and 30 of the pipe sections 18 and 24 are spaced apart to define a gap 32 therebetween.

The pier 10 further comprises a plurality of bolts 34. Each bolt 34 has a threaded shank portion 36 extending to a head 38. As is best shown at 40, the heads 38 may be secured to the first end plate 12 by welding. The heads 28 may also be secured in the first end plate 12 by filling the end plate with concrete.

The bolts 34 extend from the first end plate 12 through the apertures 16 formed therein and through the pipe sections 18 aligned with the apertures 16. The bolts 34 extend into the pipe sections 24 of the second end plate 14, and may extend into the apertures 22 thereof.

A plurality of nuts 42 are threadedly engaged with the threaded shank portions 36 of the bolts 34. The nuts 42 engage washers 44 which in turn engage the end surfaces 30 of the pipe sections 24. The washers 44 may be secured to the end surfaces 30 of the pipe sections 24, such as by welding, if desired.

The nuts 42 are utilized to control the relative positioning of the end plates 12 and 14 of the pier 10. Thus, upon relative rotation of the nuts 42 relative to the bolts 34, the separation between the two end plates 12 and 14 may be increased. One or more jam nuts 46 may also be threadedly engaged with each bolt 34. If the jam nuts 36 are utilized, the function thereof is to secure the nuts 42 in position after the desired relative positioning between the end plates 12 and 14 has been achieved.

In the practice of the invention, an excavation is formed beneath a beam 50 comprising a portion of a foundation to be leveled. A reinforced concrete pad 52 is positioned beneath the beam 50. The concrete pad 52 may either be preformed or may be cast in place.

A jack (not shown) is next employed to bring the foundation into a leveled condition. It should be noted at this point that the pier 10 of the present invention is not a jack, and is not utilized to perform a jacking function. After the jacking operation, the pier 10 of the present invention is installed between the beam 50 and the concrete pad 52. Thereafter the nuts 42 are rotated relative to the bolts 34 to bring the end plate 14 into snug engagement with the beam 50. As has been pointed out above, the pier 10 will operate with equal facility in the orientation wherein the end plate 12 engages the beam 50. If jam nuts 46 are provided on the bolts 34, the jam nuts 46 are next actuated to fix the relative positioning of the end plates 12 and 14.

A primary advantage derived from the use of the present invention involves the fact that as soon as the pier 10 has been positioned between the beam 50 and the pad 52 and the end plates 12 and 14 have been brought into snug engagement with the beam and the pad, the jack may be immediately removed. That is, the jack need not remain in place until the pier has set or cured, as is the case when a concrete pier is utilized in the leveling operation. An additional advantage deriving from the use of the invention involves the fact that should a readjustment of the leveling operation become necessary, such readjustment is readily facilitated. Thus, readjustment of the leveling operation may be carried out by utilizing a jack to make whatever readjustment in the orientation of the beam 50 is necessary, after which the pier 10 is readjusted to bring the end plates 12 and 14 into snug engagement with the underlying pad and the repositioned beam.

Although preferred embodiments of the invention have been illustrated in the accompanying Drawings and described in the foregoing Detailed Description, it will be understood that the present invention is not limited to the embodiments disclosed, but is capable of numerous rearrangements, modifications and substitutions of parts and elements without departing from the spirit of the invention.

What is claimed is:

1. A foundation leveling pier to maintain a foundation in adjusted condition, comprising:

first and second, opposed, substantially parallel end plates;

one of said end plates engaging a foundation section to be supported and the other end plate engaging an underlying concrete pad;

at least said first end plate having a plurality of apertures formed therethrough;

a first plurality of pipe sections equal in number to the number of apertures formed in the first end plate, each of the pipe sections comprising the first plurality being secured to the first end plate in alignment with one of the apertures formed therethrough and extending therefrom towards the second end plate;

a second plurality of pipe sections equal in number to the number of pipe sections comprising the first plurality, each of the pipe sections comprising the second plurality being secured to the second end plate and extending therefrom toward the first end plate and in alignment with one of the pipe sections comprising the first plurality;

a plurality of elongate externally threaded members each fixedly secured to the first end plate and extending through one of the apertures formed therein and through one of the pipe sections comprising the first plurality and into one of the pipe sections comprising the second plurality; and a plurality of internally threaded members equal in number to the number of externally threaded members and each threadedly engaging one of the externally threaded members between the respective first and second pipe sections, said internally threaded members adapted for rotational movement with respect to the externally threaded members to effect relative positioning between the first and second end plates.

2. The foundation leveling pier according to claim 1 wherein the pipe sections comprising the first and second pluralities are arranged in sets, each set of pipe sections including one pipe section from the first plurality and the aligned pipe section from the second plurality, the pipe sections comprising each set being further characterized by spaced apart, opposed end surfaces defining a gap therebetween, the pipe sections comprising each set having one of the externally threaded members extending across the gap therebetween, the internally threaded member engaging the externally threaded member being positioned in the gap between the end surfaces of the pipe sections comprising the set.

3. The foundation leveling pier according to claim 2 wherein each of the internally threaded members engages the end surface of one of the pipe sections comprising the second plurality, and wherein relative positioning between the first and second end plates is effected by force transfer from the internally threaded members through the pipe sections comprising the second plurality to the second end plate.

4. The foundation leveling pier according to claim 3 wherein the externally threaded members comprise bolts each having a head mounted in the first end plate and secured thereto by welding, and wherein the internally threaded members comprise nuts threadedly engaging the bolts.

* * * * *